US006430859B1

(12) United States Patent
Barlow

(10) Patent No.: US 6,430,859 B1
(45) Date of Patent: Aug. 13, 2002

(54) FIRING MECHANISM FOR A PYROTECHNIC FLARE SIGNALLING DEVICE

(75) Inventor: Nicholas Stewart Barlow, Andover (GB)

(73) Assignee: Flight Refuelling Limited, Dorset (GB)

( * ) Notice: Subject to any disclaimer, the term of this patent is extended or adjusted under 35 U.S.C. 154(b) by 0 days.

(21) Appl. No.: 09/671,262

(22) Filed: Sep. 28, 2000

(30) Foreign Application Priority Data

Sep. 29, 1999 (GB) ..... 9923085

(51) Int. Cl.[7] ..... F41C 3/02
(52) U.S. Cl. ..... 42/1.15; 42/69.01
(58) Field of Search ..... 42/1.15, 52, 69.01; 89/27.11, 27.13, 27.14

(56) References Cited

U.S. PATENT DOCUMENTS

| | | | | |
|---|---|---|---|---|
| 1,668,432 A | | 5/1928 | Thorstenson | |
| 2,042,934 A | * | 6/1936 | Gill | 42/2 |
| 2,444,920 A | * | 7/1948 | Davis et al. | 89/27 |
| 3,034,435 A | * | 5/1962 | Schermuly | 102/70 |
| 3,044,360 A | * | 7/1962 | Stefan et al. | 89/1 |
| 3,378,944 A | * | 4/1968 | Mainhardt et al. | 42/1 |
| 3,390,609 A | * | 7/1968 | Reepmeyer | 89/27 |
| 4,644,930 A | * | 2/1987 | Mainhardt | 124/58 |
| 5,350,392 A | | 9/1994 | Purcell et al. | |
| 5,554,166 A | | 9/1996 | Lange et al. | |
| 5,855,426 A | * | 1/1999 | Burns | 362/253 |

FOREIGN PATENT DOCUMENTS

| | | | |
|---|---|---|---|
| DE | 26549 | 6/1883 | |
| FR | 2 724 012 | 3/1996 | |
| GB | 2079419 | * 1/1982 | F42B/4/24 |
| GB | 2 079 419 | 1/1982 | |
| JP | 289778 | * 11/1989 | F41A/19/13 |

* cited by examiner

*Primary Examiner*—Charles T. Jordan
*Assistant Examiner*—Gabriel S Sukman
(74) *Attorney, Agent, or Firm*—Finnegan, Henderson, Farabow, Garrett & Dunner, L.L.P.

(57) ABSTRACT

A pyrotechnic flare signalling device firing mechanism has a tubular casing with a master plunger projecting from one end and slidable in the casing in tandem with a slave plunger which is urged against a stop pin in the casing by a coil spring acting between the plungers. A probe on the slave plunger extends towards a firing pin at the other end of the casing. A ball is located in a dished recess between the firing pin and the probe. The diameter of the ball is such that thrust imparted to the slave plunger by extension of the coil spring is transmitted to the firing pin through the ball when the device is upright whereas the probe is always spaced from the firing pin when the bail is displaced to one side because the device is not upright. The master and slave plungers are formed with cooperating spiral ramp surfaces whereby the slave plunger is rotated within the casing by urging the master plunger into contact with it while compressing the coil spring between them, that rotation of the slave plunger displacing it from the stop pin and freeing it for axial movement towards the firing pin with expansion of the coil spring.

15 Claims, 4 Drawing Sheets

FIG. 1
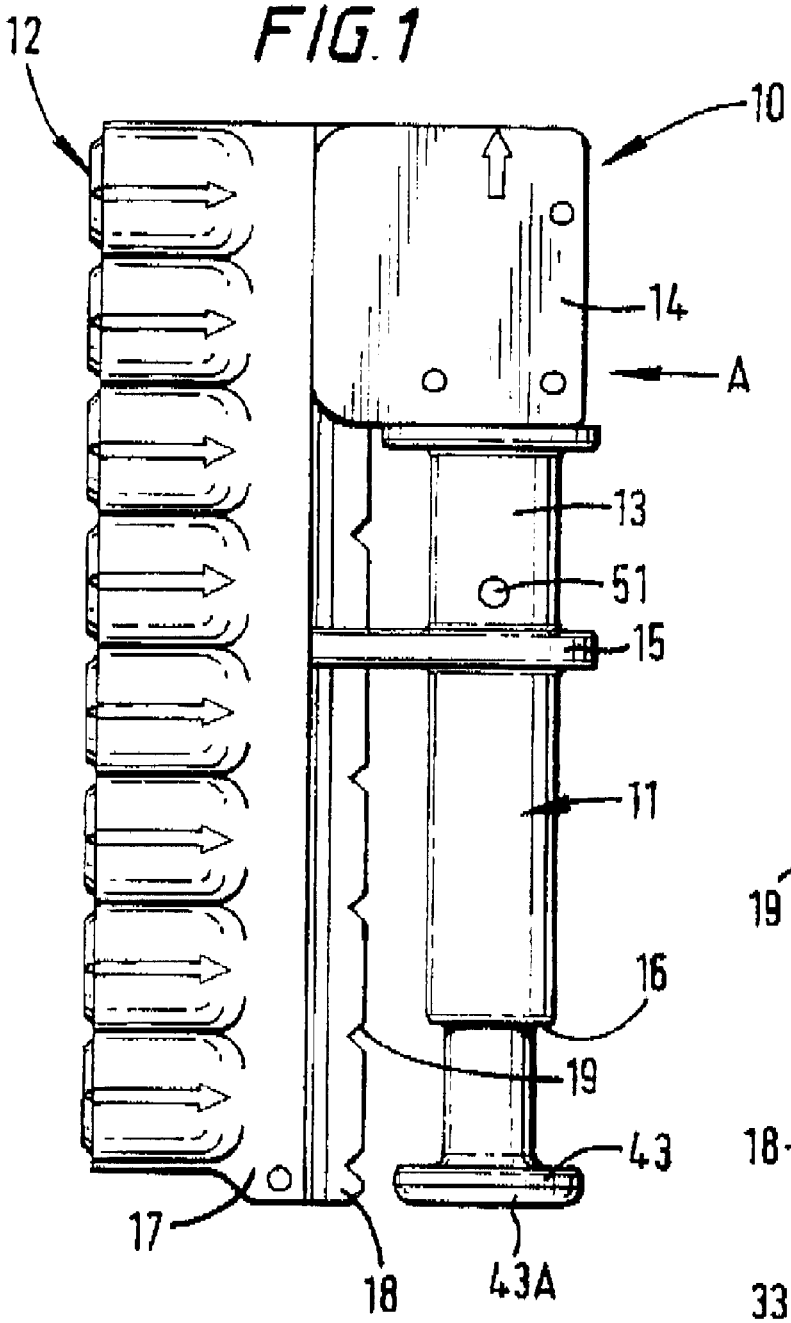
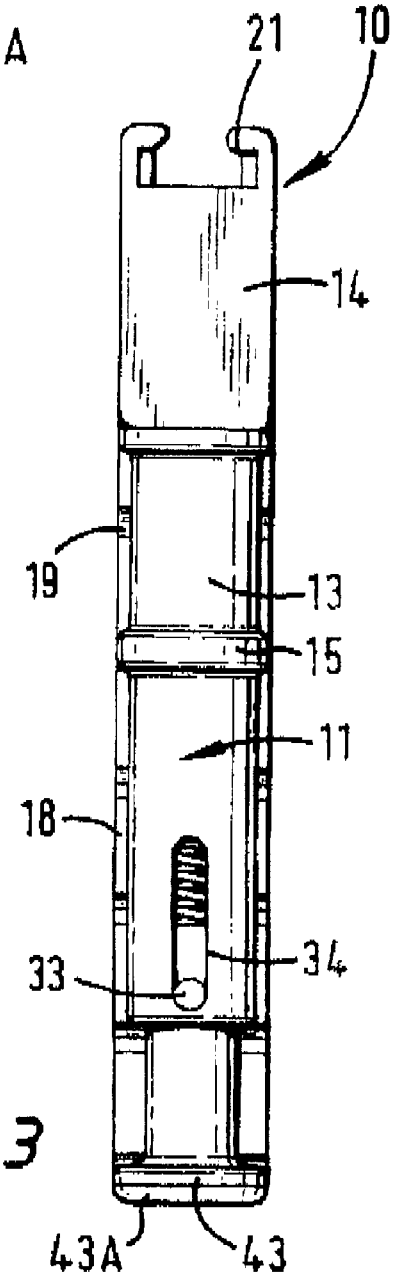
FIG. 3

FIG. 4
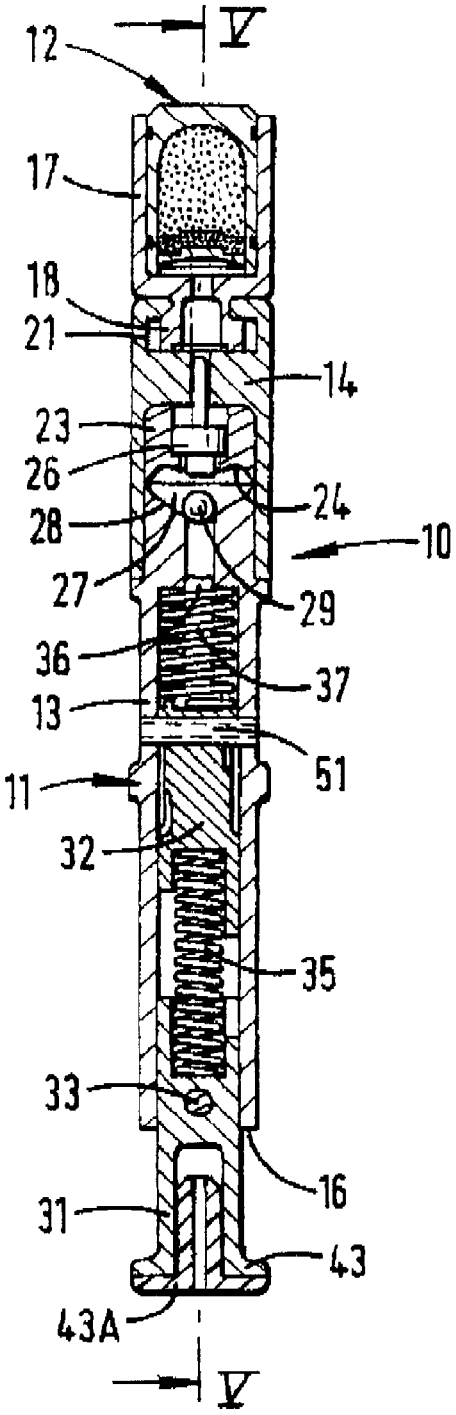
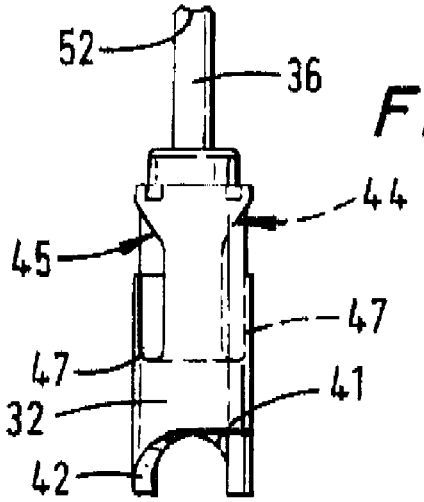
FIG. 10
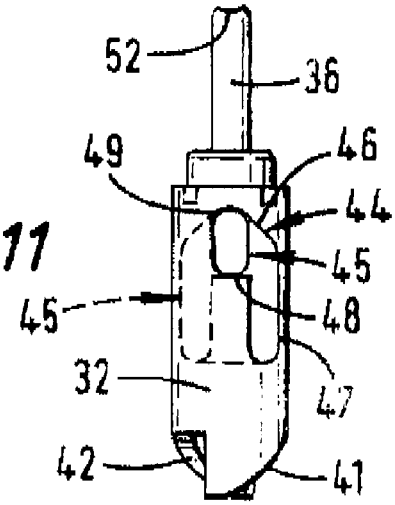
FIG. 11
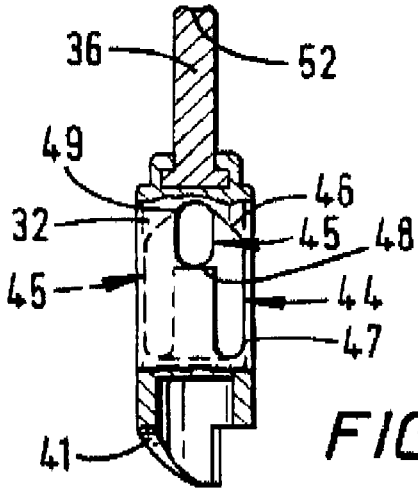
FIG. 12

FIG. 5
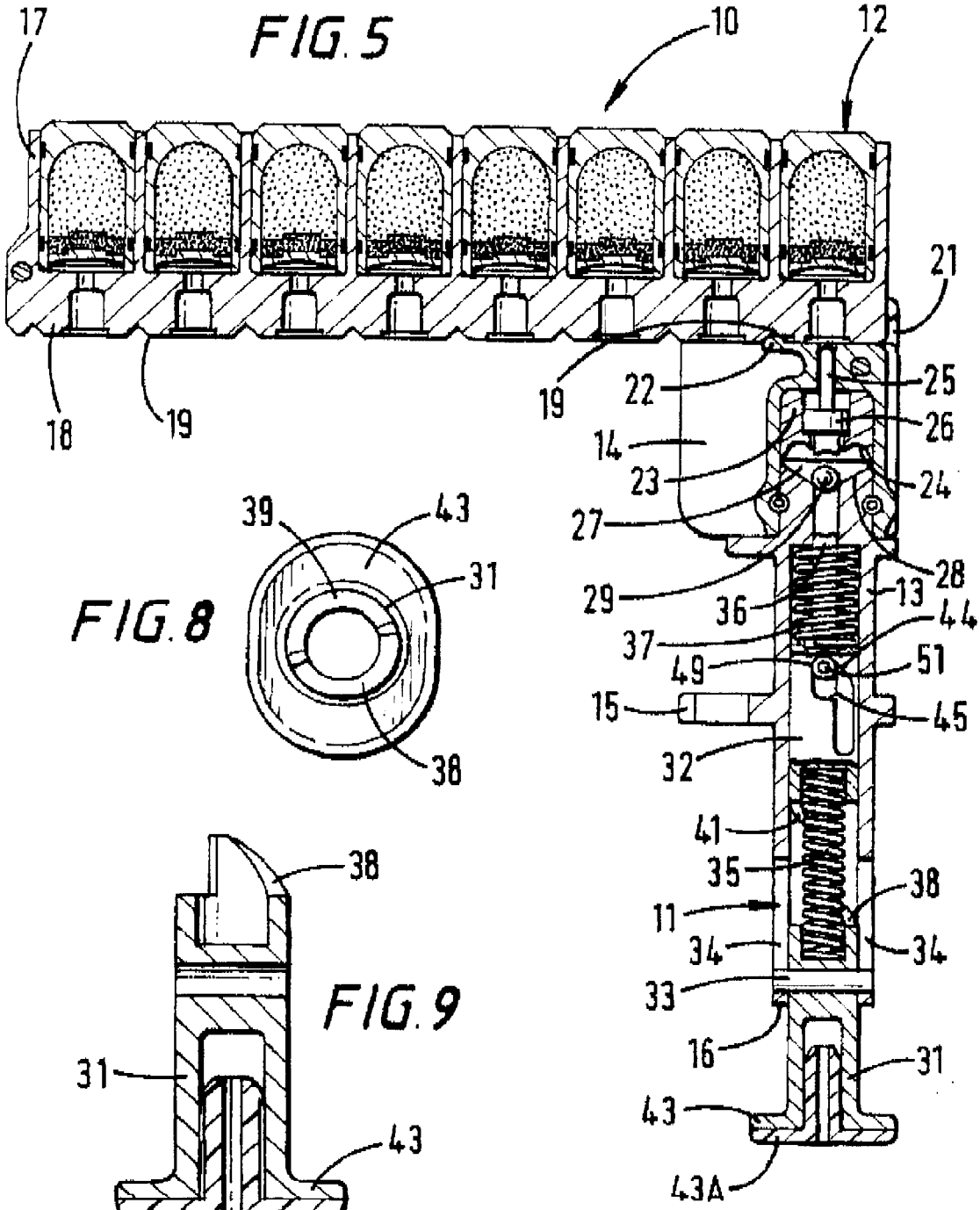
FIG. 8
FIG. 9
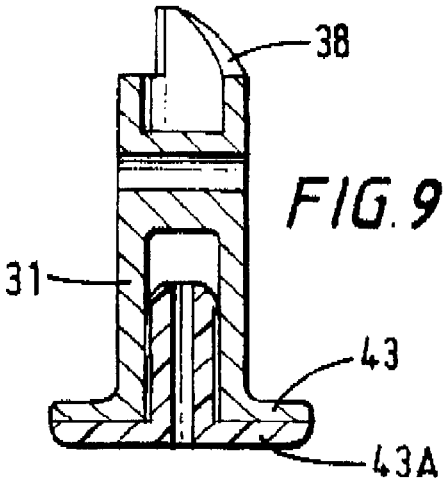

FIRING MECHANISM FOR A PYROTECHNIC FLARE SIGNALLING DEVICE

BACKGROUND OF THE INVENTION

1. Field of the Invention

2. Description of the Related Art

This invention relates to a firing mechanism for a pyrotechnic flare signalling device.

Known firing mechanisms have a hollow casing with an opening formed at one end, the casing being adapted to be fitted by said one end to a pyrotechnic flare signalling device so that the opening is aligned with ignition means of pyrotechnic means of the pyrotechnic flare signalling device. A firing pin is located within the casing and means operable when the pyrotechnic flare signalling device is fitted to said one end of the casing to thrust the firing pin through the opening to impact the ignition means and actuate the pyrotechnic means, said means that are operable to thrust the firing pin through the opening upon manual release of a trigger mechanism.

If the trigger mechanism has to be cocked by pulling a cocking lever before it can be operated to cause the firing pin to be thrust through the opening, there is a risk of misfiring due to the cocking lever having not been pulled down fully or of inadvertent firing when the mechanism has been cocked.

SUMMARY OF THE INVENTION

An object of this invention is to minimise the risk of misfiring or of inadvertent firing.

According to one aspect of this invention there is provided a firing mechanism for a pyrotechnic flare signalling device, the firing mechanism having a hollow casing with an opening formed by one end, the casing being adapted to be fitted by said one end to the pyrotechnic flare signalling device so that the opening is aligned with ignition means of pyrotechnic means of the pyrotechnic flare signalling device, a firing pin within the casing and means operable when the pyrotechnic flare signalling device is fitted to said one end of the casing to thrust the firing pin through the opening to impact the ignition means and actuate the pyrotechnic means, said means that are operable to thrust the firing pin through the opening, including an energy storage device, means operable to load the energy storage device, releasable catch means operable to hold the energy storage device in a loaded condition and releasable to cause or allow release of energy by said energy storage-device whereby to generate the thrust that thrusts the firing pin through the opening, a plunger slidably mounted within an axially extending chamber which is formed by the interior of the casing, said releasable catch means being operable to hold the plunger against movement towards said opening and releasable to free the plunger for movement towards said opening, and a trigger mechanism which is adapted to be actuated to release said catch means and allow said plunger to be urged towards said opening by release of energy by said energy storage device, wherein the plunger is rotatable about its axis within a cylindrical portion of the chamber as well as being axially slidable therein, the releasable catch means including a stop member which is carried by the casing and which is adapted to be abutted by an abutment on the plunger when the plunger is in one angular orientation relative to the casing whereby to stop axial movement of the plunger towards said opening, said plunger being formed so as to bypass said stop member when the plunger is displaced angularly from said one angular orientation relative to the casing so that said abutment is displaced angularly with respect to said stop member and the plunger is free to slide towards the opening past the stop member, said trigger mechanism including means operable to rotate the plunger after said energy storage device has been loaded to a certain extent whereby the abutment is displaced angularly with respect to the stop member with further loading of the energy storage device.

Preferably the plunger is a slave plunger and the trigger mechanism includes a master plunger slidably mounted in tandem with the slave plunger within said axially extending chamber, resilient means which act between the plungers to oppose reduction of a gap between them, the master plunger being movable towards the slave plunger and thereby to compress the resilient means when the slave plunger is held by the catch means, and catch release means which are adapted to be actuated to release said catch means by advancement of said master plunger to a certain location relative to the slave plunger, the arrangement being such that, after an initial advance of the master plunger towards the slave plunger which compresses said resilient means, said catch means are released and said slave plunger is urged towards the opening by expansion of the resilient means whereby to generate the thrust that is applied to the firing pin.

Conveniently the means operable to rotate the slave plunger are means on the master and slave plungers which are adapted to interact so that axial displacement of the master plunger is converted into angular displacement of the slave plunger. The means on the master and slave plungers may be axially aligned spiral ramp surfaces, the spiral ramp surface on the master plunger being brought into face to face contact with the spiral ramp surface on the slave plunger as the master plunger arrives at said certain location, further linear advance of the master plunger towards the opening causing the spiral ramp surface on the slave plunger to slide on the spiral ramp surface of the master plunger so that the slave plunger is rotated about its axis. The portions of the master and slave plungers that face one another may be tubular, the end of each tubular portion that faces the tubular portion of the other plunger forming a diametrically opposed pair of such spiral ramp surfaces.

In a preferred embodiment, the slave plunger has a slot formed in it, the slot forming a lateral aperture that extends through the slave plunger from side to side, the slot being elbow shaped and having a laterally extending portion and an axially extending portion, the laterally extending portion being at the end of the axially extending portion that is nearer to said opening, the laterally extending portion and the axially extending portion of the slot forming a shoulder at the end of the laterally extending slot portion remote from the opening, that shoulder serving as said abutment, and said stop member comprising a pin which extends through the slot and which is anchored at its end in the casing on either side of the slave plunger. The edge of the laterally extending portion of the slot that forms said abutment may extend substantially radially with respect to the slave plunger. Furthermore the edge of the laterally extending slot portion that is nearer to said opening may be oblique to the axis Of the slave plunger so that the laterally extending slot portion diverges away from the axially extending slot portion.

The tubular portion of the slave plunger may be closed at its end nearer to said opening, the slave plunger carrying a reduced diameter probe portion which projects towards said opening. The end of the reduced diameter probe portion of the slave plunger may have a dished recess formed therein.

Preferably the firing mechanism includes means limiting the stroke of axial movement of the slave plunger and of the firing pin such that they are spaced one from the other even when the slave plunger is closest to the firing pin, wherein a gravity responsive element is provided and arranged to assume a rest position between the slave plunger and the firing pin when the casing is upright for firing with the opening at the top and the slave plunger is below the firing pin but above the master plunger, the dimensions of the gravity responsive element being such that it can be raised from its rest position and moved into contact with the firing pin by the slave plunger whereby the thrust is transmitted from the slave plunger to the firing pin through the gravity responsive element when the casing is upright for firing whereas it would be displaced from between the slave plunger and the firing pin when the casing is not upright so that thrust cannot be transferred from the slave plunger to the firing pin. This arrangement has the advantage that the flare signalling device can only be fired when the firing mechanism is upright so that it is unlikely to be usable as an offensive weapon.

Conveniently the gravity responsive element is spherical and is located in a dished recess which is concave to the firing pin and which is formed by said casing, there being an axially extending passage which extends from the center of the recess towards the slave plunger to receive a portion of the slave plunger which is slidable therein. Resilient biassing means which urge said slave plunger away from said opening may be provided.

According to another aspect of this invention there is provided a firing mechanism for a pyrotechnic flare signalling device, the firing mechanism having a hollow casing with an opening formed at one end, the casing being adapted to be fitted by said one end to the pyrotechnic flare signalling device so that the opening is aligned with ignition means of pyrotechnic means of the pyrotechnic flare signalling device, a firing pin which is constrained for rectilinear movement within the casing and means operable when the pyrotechnic flare signalling device is fitted to said one end of the casing to thrust the firing pin through the opening to impact the ignition means and actuate the pyrotechnic means, said means that are operable to thrust the firing pin through the opening including an energy storage device, means operable to load the energy storage device, releasable catch means operable to hold the energy storage device in a loaded condition and releasable to cause or allow release of energy by said energy storage device whereby to generate the thrust that thrusts the firing pin through the opening, and a trigger mechanism operable to release the catch means, the trigger mechanism including a plunger which is slidably mounted within an axially extending chamber which is formed by the interior of the casing, said releasable catch means being operable to hold the plunger against movement towards said opening and releasable to Free the plunger for movement towards said opening, means limiting the stroke of axial movement of the plunger and the firing pin within the casing such that they are spaced one from the other even when the plunger is closest to the firing pin, said trigger mechanism being adapted to be actuated to release said catch means and allow said plunger to be urged towards said opening by release of energy by said energy storage device, wherein a gravity responsive element is provided and arranged to assume a rest position between the plunger and the firing pin when the casing is upright for firing with the opening at the top and the plunger below the tiring pin, the dimensions of the gravity responsive element being such that it can be raised and moved into contact with the firing pin by the plunger whereby the thrust is transmitted from the plunger to the firing pin through the gravity responsive element when the casing is upright for tiring whereas it will be displaced from between the plunger and the firing element when the casing is not upright so the thrust cannot be transferred from the plunger to the firing pin.

BRIEF DESCRIPTION OF THE DRAWINGS

A pyrotechnic flare signalling device which embodies this invention is described now by way of example only, with reference to the accompanying drawings, of which:

FIG. 1 is a side elevation of the device in an inoperative state for stowage;

FIG. 3 is an end elevation as seen in the direction of arrow A in FIG. 1;

FIG. 4 is a schematic view in section of the device shown in FIGS. 1 to 3, the section being on the line IV—IV in FIG. 2;

FIG. 5 is a schematic section on the line V—V in FIG. 4;

FIG. 8 is a plan view of the master plunger as shown in FIG. 6;

FIG. 9 is a section on the line IX—IX in FIG. 6;

FIG. 10 is a view in elevation of a slave plunger of the firing mechanism as shown schematically in FIG. 4;

FIG. 11 is a side elevation of the slave plunger shown in FIG. 10; and

FIG. 12 is a view similar to FIG. 11 but partly sectioned on the centre line of FIG. 10.

DETAILED DESCRIPTION OF THE PREFERRED EMBODIMENTS

Figures 2, 6, 7:
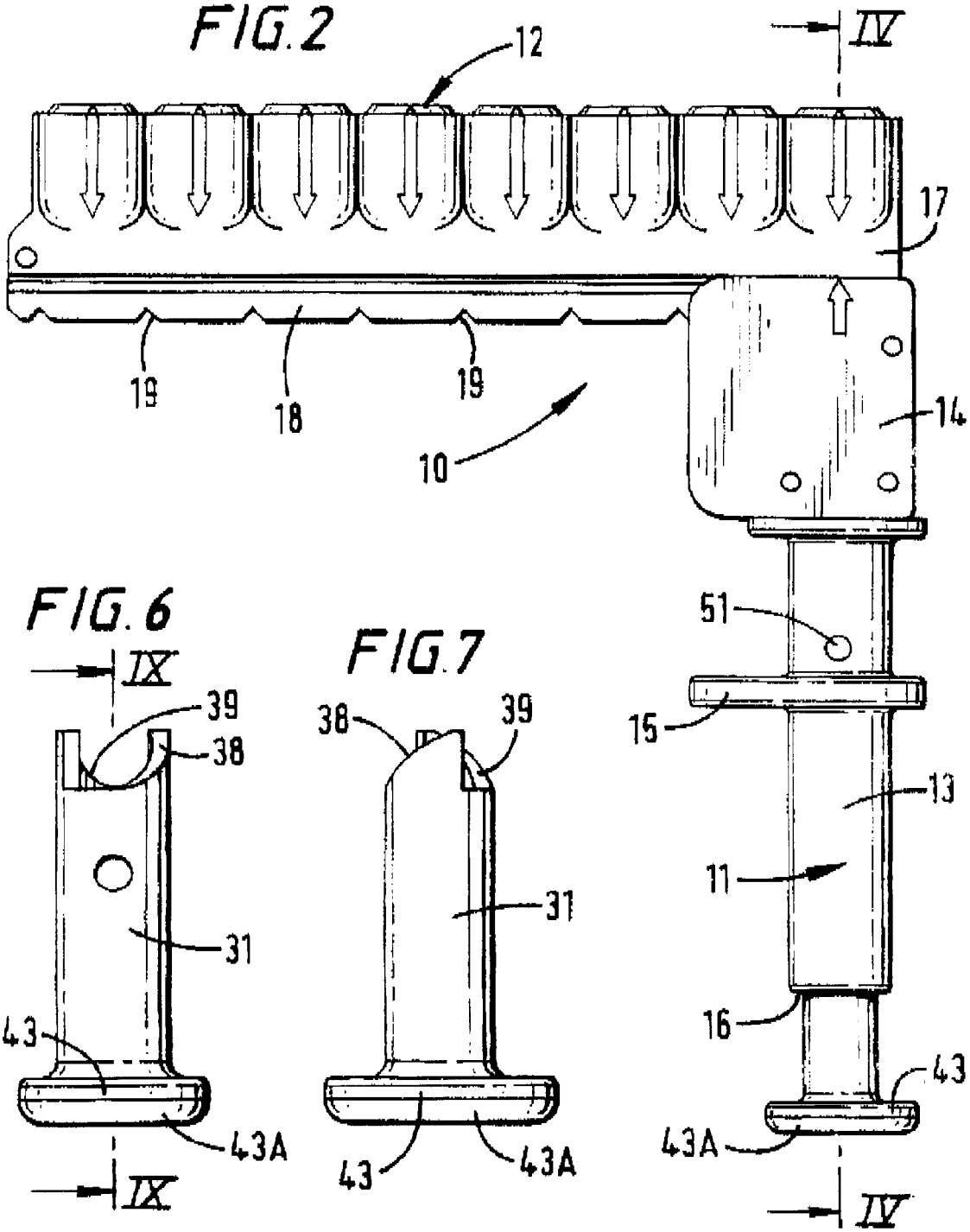
FIG. 2 is a side elevation of the device of FIG. 1 in which it is assembled for use.
FIG. 6 is a view in elevation of a master plunger of a firing mechanism of the device as shown schematically in FIG. 4.
FIG. 7 is a side elevation of the master plunger as shown in FIG. 6.

FIGS. 1 and 2 show that the pyrotechnic flare signalling device (10) is a firing mechanism (11) fitted with a bank of flares (12). The firing mechanism (11) has a generally tubular casing (13) with a rectangular head block (14) at one end. The longitudinal axis of the tubular casing (13) is off-set with respect to the center of the rectangular head block (14). An arm (15) projects laterally from the tubular casing (13) at a location which is spaced from the head block (14) and from the other end (16) of the tubular casing (13). The arm (15) and the head block (14) project to the same side of the tubular casing (13).

The bank of flares (12) comprises a row of flares in a casing (17). The casing (17) forms a row of stepped through bores, each flare being fitted into the larger diameter bore portion of a respective one of the through bores with its percussion ignition portion spanning the inner end of the smaller diameter bore portion. The open ends of the larger diameter bore portions are formed in one side of the casing (17) which is opposite to a longitudinally extending tongue (18) which is formed by the opposite side of the casing (17) and through which the smaller diameter portions of the stepped bores extend. The open end of each smaller diameter bore portion that extends through the tongue (18) is displaced to the right, as seen in FIG. 5, from a respective notch (19) which is formed in the outer surface of the tongue (18).

The tongue (18) is a push fit in a slot which is formed in the side of the head block (14) that is further from the axis of the tubular casing (13) as well as in an aligned slot which is formed in the respective end-of the arm (15). The bank of flares (12) is fitted into both these slots, as shown in FIG. 1, when the device is inoperative so that it is compact and secure for stowage.

The tongue (18) is formed as a dovetail. It is a sliding fit into a correspondingly shaped groove (21) which is formed in the end face of the head block (14) that is remote from the tubular casing (13) and that intersects the axis of the tubular casing (13). FIG. 5 shows that a detent clip (22) is formed integrally in that end face of the head block (14). The detent clip (22) is a resilient finger of plastics material which projects from the remainder of the head block (14) and which is formed with a bulbous end portion at its free end. The bulbous end portion is spaced from the axis of the tubular casing (13) by the same distance as is each of the notches (19) from the axis of the respective stepped through bore in the casing (17). Hence the bulbous end portion of the detent clip (22) is held engaged in a respective one of the notches (19) by the resilience of the finger so as to locate the respective stepped through bore co-axially with the axis of the tubular casing (13). A detent pin which is mounted in that end face of the head block (14) at a similar location to the detent clip (22) could be used instead of the detent clip (22) for the same purpose.

The head block (14) is formed with a stepped through bore which has one end bore portion which opens into the dovetail slot (21) and another, longer and larger diameter end bore portion. This stepped through bore portion is co-axial with the axis of the tubular casing (13) which is spigotted into the larger diameter end bore portion. The portion of the casing (13) within the larger diameter end bore portion of the stepped through bore in the head block (14) is spaced from the annular shoulder that joins the two end bore portions. An annular part (23) is seated on that annular shoulder and is formed with a stepped through bore itself, its larger diameter end bore portion being nearer to that annular shoulder than is its smaller diameter end bore portion which faces the tubular casing (13). The end face of the annular part (23) that faces the tubular casing (13) forms an annular concave recess (24).

A firing pin (25) is mounted on a stepped plunger (26) and projects into the smaller diameter bore portion of the stepped through bore through the head block (14) with a clearance therearound. The larger diameter portion of the stepped plunger (26) is a sliding fit in the larger diameter end bore portion of the annular part (23). The smaller diameter portion of the stepped plunger (26) projects through the smaller diameter end bore portion of the annular part (23) into a cavity (27) which is formed between the annular part (23) and the tubular casing (13).

The end face (28) of the tubular casing (13) that is within the larger diameter end bore portion of the stepped through bore through the head block (14) and that co-operates with the annular concave recess (24) to bound the cavity (27) is frusto-conical, tapering away from the annular concave recess (24).

The bore of the tubular casing (13) is stepped, the smaller diameter end portion of that stepped through bore opening at the center of the frusto-conical face (28) and extending approximately to the end of the head block (14) that is remote from the dovetail groove (21).

A ball (29) is located in the cavity (27) and has a diameter which is greater than the diameter of the smaller diameter end portion of the stepped through bore of the tubular casing (13). Hence the ball (29) seats in the mouth of that smaller diameter end bore portion when the tubular casing (13) is upright with the frusto-conical face (28) at its upper end.

A releasable catch and trigger mechanism for operating the firing mechanism (11) is mounted in the stepped through bore of tubular casing (13). It includes two plungers (31 and 32) which are slidably mounted in tandem in the larger diameter portion of the bore of the tubular casing (13).

One of those plungers (31), which functions as a master plunger, projects through the open end (16) of the tubular casing (13). The master plunger (31) carries a laterally projecting pin (33). Each end of the pin (33) projects into a respective one of a diametrically opposed pair of closed ended slots (34) which are formed in the wall of the tubular casing (13).

The second plunger (32), which functions as a slave plunger, carries a smaller diameter probe (36) which is a sliding fit in the smaller diameter end portion of the stepped bore of the tubular casing (13). The probe (36) has an enlargement at one end which is captured in a cavity formed in the slave plunger (32) and from which the probe (36) projects through a mouth of the cavity. A light coil spring (37) reacts against the shoulder between the two bore portions of the stepped bore of the tubular casing (13) and urges the slave plunger (32) towards the master plunger (31). The spring (37) is anchored at either end by fitting a tang formed at each end into a respective cavity formed in either the tubular casing or the slave plunger (32). Hence the spring (37) is held against rotation.

FIGS. 6 to 12 show the two plungers (31 and 32) in more detail. The adjacent portions of the two plungers (31 and 32) are tubular. The adjacent ends of the two plungers (31 and 32) are similar. They are both formed with a diametrically opposed pair of spiral ramp surfaces, the pair of spiral ramp surfaces (38 and 39) of the master plunger (31) facing the pair of spiral ramp surfaces (41 and 42) of the slave plunger.

A compression spring (35) acts between the two plungers (31 and 32). It seats at either end on a closed end of a respective one of the tubular portions of the plungers (31 and 32).

The master plunger (31) has an enlarged head (43) at its end which projects from the open end (16) of the tubular casing (13). An oval pad (43A) of elastomeric material, which is formed with an integral central tubular stem, is spigotted into a blind bore which is formed centrally in the master plunger (31) from its enlarged head (43). The end of the stem is formed with an annular barb whereby the pad (43A) is held in the blind bore.

FIGS. 10 to 12 show that the slave plunger (32) is formed with two diametrically opposed elbow shaped slots (44 and 45) in the wall of its tubular portion. Each slot (44, 45) has a laterally extending portion (46) and an axially extending portion (47). The laterally extending portion (46) is at the end of the axially extending portion (47) that is nearer to the probe (36). A right angled shoulder (48) is formed at the junction of the laterally extending portion (46) and the axially extending portion (47) by the edge of the laterally extending portion (46) that is further from the probe (36) and by the adjacent edge of the axially extending portion (47). The other edge of the axially extending portion (46) is oblique to the axis of the tubular casing (13), diverging from the shoulder (48) and merging into an arciate corner (49) at the end of the respective elbow shaped slot (44, 45) that is nearer to the probe (36).

FIG. 5 shows that a pin (51) extends through the two elbow shaped slots (44 and 45). The pin (51) projects from either side of the slave plunger (32). FIG. 4 shows that the pin (51) is anchored at either end in the tubular casing (13).

FIG. 12 shows that the end of the probe (36) forms a part spherical recess (52).

In order to prepare the flare signalling device (10) for firing, starting from the stowage condition shown in FIG. 1, the bank of flares (12) is disengaged from the slots in the arm (15) and the side of the head block (14) by pivoting the casing(17) about the end of the slot in the head block (14) that is remote from the arm (15), keeping the end of the tongue (18) engaged therein until the tongue (18) is aligned with the dovetail groove (21). The casing is then pushed laterally relative to the head block (14) so as to slide the tongue (18) into the dovetail groove (21). The casing (17) is pushed to slide the tongue (18) into the dovetail groove (21) until the detent (22) engages in the notch (19) that is between the first two flares of the bank (12) that have not been fired. Thus the first of those unfired flares is aligned with the firing pin (25) and the flare signalling device is ready for firing.

FIGS. 3, 4 and 5 show that, in this condition, the slave plunger (32) held by the light coil spring (37) against the pin (51) which is seated in the arcuate corners (49) of the elbow shaped slots (44 and 45), the probe (36) being spaced from the ball (29) and with its end portion, which forms the part pherical recess (52), projecting a short distance into the smaller diameter bore portion of the tubular casing (13). Also, due to the action of the compression spring (35) the master plunger (31) is at the end of its stroke that is furthest from the bank of flares (12), with the pin (33) in abutment with the respective ends of the slots (34) in the tubular casing (13).

In order to fire the flare that is aligned with the firing pin (25), the operator takes the tubular casing (13) in one hand with at least his middle and index fingers placed around the side of the arm (15) that is nearer to the bank of flares (12) and with the thumb or palm of that hand engaged with the pad (43A) of elastomeric material of the master plunger (31). The operator then squeezes his thumb or palm towards his other fingers thereby urging the master plunger (31) into the larger diameter bore portion of the tabular casing (13). The oval pad (43A) is provided for the comfort of the operator, Initial rectilinear movement of the master plunger (31) into the larger diameter bore portion of the tubular casing (13) is transmitted by the compression spring (35) to the slave plunger (32) and is followed by similar rectilinear movement of the slave plunger (32) without significant compression of the compression spring (35) and against the bias load of the light coil spring (37), until such rectilinear movement of the slave plunger (32) is stopped by abutment of the pin (51) against the shoulders (48) of the elbow shaped slots (44 and 45). The operator continues his squeezing action so that the master plunger (31) is urged further into the larger diameter bore portion of the tubular casing (13) and the compression spring (35) is compressed and thereby loaded. This continues until the spiral ramp surfaces (38 and 39) of the master plunger (31) are brought into face to face contact with the spiral ramp surfaces (41 and 42) of the slave plunger (32). The operator continues squeezing so that the master plunger (31) is urged further into the larger diameter bore portion of the tubular casing (13). Such further rectilinear movement of the master plunger (31) into the tubular casing (13) causes its spiral ramp surfaces (38 and 39) to slide along the mating spiral ramp surfaces (41 and 42) of the slave plunger (32) thus causing the slave plunger (32) to be displaced angularly about its own axis within the larger diameter bore portion of the tubular casing (13). Such rectilinear movement of the master plunger (31) into the tubular casing (13) causes such angular displacement of the slave plunger (32) therein until the pin (51) ceases to act as a stop member holding the slave plunger (32) against axial movement within the tubular casing (13) due to the angular displacement of the slave plunger (32) being sufficient to displace the shoulders (48) out of axial alignment with the pin (51). The axially extending portions (47) of the elbow shaped slots (44 and 45) will then be aligned with the pin (51) so that the slave plunger (32) is freed for rectilinear movement within the larger diameter bore portion of the tubular casing (13) to the extent allowed by the length of the axially extending slots (46). Once the pin (51) ceases to be a stop member in abutment with the shoulders (48), the slave plunger (32) is thrust by expansion of the compression spring (35) to urge its probe (36) through the smaller diameter bore portion of the tubular casing (13) and into the cavity (27). Providing the operator is holding the firing mechanism (11) with the tubular casing (13) upright, say within a range of 30° either side of the true vertical, the ball (29) will be held by gravity seated in the upper end of the smaller diameter bore portion of the tubular casing part (13) so that it will be picked up in the part spherical recess (52) at the end of the probe portion (36) and urged against the stepped plunger (26) to thrust the firing pin (25) through the aperture formed by the aligned smaller diameter portion of the stepped bore through the casing (17) and into firing contact with the percussion ignition portion of the flare to ignite the flare.

Should the operator attempt to fire the firing mechanism (11) without holding the firing mechanism (11) upright so that the longitudinal axis of the firing mechanism (11) is at an angle greater than 30° to the vertical, the ball (29) will be displaced by gravity into the peripheral portion of the cavity (27) and to one side of the path of rectilinear movement of the probe (36) so that it will not be picked up by the probe (36) as it is thrust towards the firing pin (25). Hence no contact will be made with the stepped plunger (26) since the stroke of rectilinear movement of the slave plunger (32) is limited by the axial length of the axially extending portions (47) of the elbow shaped slots (44 and 45) to an extent that the part spherical recess (52) at the end of the probe (36) will not make direct contact with the stepped plunger (46) so that the firing pin (25) will not be thrust towards the ignition means of the flare.

The operator releases the master plunger (31) when the flare has been fired. Hence the compression spring (35) expands urging the pin (33) to the end of the slots (34) remote from the firing pin (25). The slave plunger (32) is caused to follow by the action of the light coil spring (37). Such following movement of the slave plunger (32) is axial initially. It continues to be so until the pin (51) engages the oblique edges of the laterally extending slot portions (46) of the elbow shaped slots (44 and 45). Further movement of the slave plunger (32) away from the firing pin (25), due to the action of the light coil spring (37), has an angular component and continues until the pin (51) seats in the arcuate corners (49) of the elbow shaped slots (44). The firing mechanism (11) is then in a condition to fire another flare. Should the operator wish to fire another flare he pushes the casing (17) to the right as seen in FIGS. 2 and 5 until the bulbous end of the resilient finger of the detent chip (22) engages the next notch (19) so that the next flare is aligned with the firing pin.

Although the head block (14) and the annular part (23) are described as separate portions, one spigotted into the other, they could be formed as a one piece moulding.

What is claimed is:

1. A firing mechanism for a pyrotechnic flare signalling device, the firing mechanism having a hollow casing with an opening formed by one end, the casing being adapted to be fitted by said one end to the pyrotechnic flare signalling device so that the opening is aligned with ignition means of pyrotechnic means of the pyrotechnic flare signalling device, a firing pin within the casing and means operable when the pyrotechnic flare signalling device is fitted to said one end of the casing to thrust the firing pin through the opening to impact the ignition means and actuate the pyrotechnic means, said means that are operable to thrust the firing pin through the opening, including an energy storage device, means operable to load the energy storage device, releasable catch means operable to hold the energy storage device in a loaded condition and releasable to cause or allow release of energy by said energy storage device whereby to generate the thrust that thrusts the firing pin through the opening, a plunger slidably mounted within an axially extending chamber which is formed by the interior of the casing, said releasable catch means being operable to hold the plunger against movement towards said opening and releasable to free the plunger for movement towards said opening, and a trigger mechanism which is adapted to be actuated to release said catch means and allow said plunger to be urged towards said opening by release of energy by said energy storage device, wherein the plunger is rotatable about its axis within a cylindrical portion of the chamber as well as being axially slidable therein, the releasable catch means including a stop member which is carried by the casing and which is adapted to be abutted by an abutment on the plunger when the plunger is in one angular orientation relative to the casing whereby to stop axial movement of the plunger towards said opening, said plunger being formed so as to bypass said stop member when the plunger is displaced angularly from said one angular orientation relative to the casing so that said abutment is displaced angularly with respect to said stop member and the plunger is free to slide towards the opening past the stop member, said trigger mechanism including means operable to rotate the plunger after said energy storage device has been loaded to a certain extent and to displace the abutment angularly with respect to the stop member with further loading of the energy storage device.

2. A firing mechanism for a pyrotechnic flare signalling device, the firing mechanism having a hollow casing with an opening formed by one end, the casing being adapted to be fitted by said one end to the pyrotechnic flare signalling device so that the opening is aligned with ignition means of pyrotechnic means of the pyrotechnic flare signalling device, a firing pin within the casing and means operable when the pyrotechnic flare signalling device is fitted to said one end of the casing to thrust the firing pin through the opening to impact the ignition means and actuate the pyrotechnic means, said means that are operable to thrust the firing pin through the opening, including an energy storage device, means operable to load the energy storage device, releasable catch means operable to hold the energy storage device in a loaded condition and releasable to cause or allow release of energy by said energy storage device whereby to generate the thrust that thrusts the firing pin through the opening, a plunger slidably mounted within an axially extending chamber which is formed by the interior of the casing, said releasable catch means being operable to hold the plunger against movement towards said opening and releasable to free the plunger for movement towards said opening, and a trigger mechanism which is adapted to be actuated to release said catch means and allow said plunger to be urged towards said opening by release of energy by said energy storage device, wherein the plunger is rotatable about its axis within a cylindrical portion of the chamber as well as being axially slidable therein, the releasable catch means including a stop member which is carried by the casing and which is adapted to be abutted by an abutment on the plunger when the plunger is in one angular orientation relative to the casing whereby to stop axial movement of the plunger towards said opening, said plunger being formed so as to bypass said stop member when the plunger is displaced angularly from said one angular orientation relative to the casing so that said abutment is displaced angularly with respect to said stop member and the plunger is free to slide towards the opening past the stop member, said trigger mechanism including means operable to rotate the plunger after said energy storage device has been loaded to a certain extent whereby the abutment is displaced angularly with respect to the stop member with further loading of the energy storage device, wherein said plunger is a slave plunger and said trigger mechanism includes a master plunger slidably mounted in tandem with the slave plunger within said axially extending chamber, resilient means which act between the plungers to oppose reduction of a gap between them, the master plunger being movable towards the slave plunger and thereby to compress the resilient means when the slave plunger is held by the catch means, and catch release means which are adapted to be actuated to release said catch means by advancement of said master plunger to a certain location relative to the slave plunger, the arrangement being such that, after an initial advance of the master plunger towards the slave plunger which compresses said resilient means, said catch means are released and said slave plunger is urged towards the opening by expansion of the resilient means whereby to generate the thrust that is applied to the firing pin.

3. A firing mechanism according to claim 2, wherein said means operable to rotate the slave plunger are means on the master and slave plungers which are adapted to interact so that axial displacement of the master plunger is converted into angular displacement of the slave plunger.

4. A firing mechanism according to claim 3, wherein means on the master and slave plungers are axially aligned spiral ramp surfaces, the spiral ramp surface on the master plunger being brought into face to face contact with the spiral ramp surface on the slave plunger as the master plunger arrives at said certain location, further linear advance of the master plunger towards the opening causing the spiral ramp surface on the slave plunger to slide on the spiral ramp surface of the master plunger so that the slave plunger is rotated about its axis.

5. A firing mechanism according to claim 4, wherein the portions of the master and slave plungers that face one another are tubular, the end of each tubular portion that faces the tubular portion of the other plunger forming a diametrically opposed pair of such spiral ramp surfaces.

6. A firing mechanism according to claim 2, wherein the slave plunger has a slot formed in it, the slot forming a lateral aperture that extends through the slave plunger from side to side, the slot being elbow shaped and having a laterally extending portion and an axially extending portion, the laterally extending portion being at the end of the axially extending portion that is nearer to said opening, the laterally extending portion and the axially extending portion of the slot forming a shoulder at the end of the laterally extending slot portion remote from the opening, that shoulder serving as said abutment, and said stop member comprising a pin which extends through the slot and which is anchored at its ends in the casing on either side of the slave plunger.

7. A firing mechanism according to claim 6, wherein the edge of the laterally extending portion of the slot that forms said abutment extends substantially radially with respect to the slave plunger.

8. A firing mechanism according to claim 6, wherein the edge of the laterally extending slot portion that is nearer to said opening is oblique to the axis of the slave plunger so that the laterally extending slot portion diverges away from the axially extending slot portion.

9. A firing mechanism according to claim 5, wherein the tubular portion of the slave plunger is closed at its end nearer to said opening, the slave plunger carrying a reduced diameter probe portion which projects towards said opening.

10. A firing mechanism according to claim 9, wherein the end of said reduced diameter probe portion of the slave plunger has a dished recess formed therein.

11. A firing mechanism according to claim 2, including means limiting the stroke of axial movement of the slave plunger and of the firing pin such that they are spaced one from the other even when the slave plunger is closest to the firing pin, wherein a gravity responsive element is provided and arranged to assume a rest position between the slave plunger and the firing pin when the casing is upright for firing with the opening at the top and the slave plunger is below the firing pin but above the master plunger, the dimensions of the gravity responsive element being such that it can be raised from its rest position and moved into contact with the firing pin by the slave plunger whereby the thrust is transmitted from the slave plunger to the firing pin through the gravity responsive element when the casing is upright for firing whereas it would be displaced from between the slave plunger and the firing pin when the casing is not upright so that thrust cannot be transferred from the slave plunger to the firing pin.

12. A firing mechanism according to claim 11, wherein the gravity responsive element is spherical and is located in a dished recess which is concave to the firing pin and which is formed by said casing, there being an axially extending passage which extends from the center of the recess towards the slave plunger to receive portion of the stave plunger which is slidable therein.

13. A firing mechanisim according to claim 2, including resilient biassing means which urge said slave plunger away from said opening.

14. A firing mechanism for a pyrotechnic flare signalling device, the firing mechanism having a hollow casing with an opening formed at one end, the casing being adapted to be fitted by said one end to the pyrotechnic flare signalling device so that the opening is aligned with ignition means of pyrotechnic means of the pyrotechnic flare signalling device, a firing pin which is constrained for rectilinear movement within the casing and means operable when the pyrotechnic flare signalling device is fitted to said one end of the casing to thrust the firing pin through the opening to impact the ignition means and actuate the pyrotechnic means, said means that are operable to thrust the firing pin through the opening including an energy storage device, means operable to load the energy storage device, releasable catch means operable to hold the energy storage device in a loaded condition and releasable to cause or allow release of energy by said energy storage device whereby to generate the thrust that thrusts the firing pin through the opening, and a trigger mechanism operable to release the catch means, the trigger mechanism including a plunger which is slidably mounted within an axially extending chamber which is formed by the interior of the casing, said releasable catch means being operable to hold the plunger against movement towards said opening and releasable to free the plunger for movement towards said opening, means limiting the stroke of axial movement of the plunger and the firing pin within the casing such that they are spaced one from the other even when the plunger is closest to the firing pin, said trigger mechanism being adapted to be actuated to release said catch means and allow said plunger to be urged towards said opening by release of energy by said energy storage device, wherein a gravity responsive element is provided and arranged to assume a rest position between the plunger and the firing pin when the casing is upright for firing with the opening at the top and the plunger below the firing pin, the dimensions of the gravity responsive element being such that it can be raised and moved into contact with the firing pin by the plunger whereby the thrust is transmitted from the plunger to the firing pin through the gravity responsive element when the casing is upright for firing whereas it will be displaced from between the plunger and the firing element when the casing is not upright so the thrust cannot be transferred from the plunger to the firing pin.

15. A firing mechanism according to claim 14, wherein the gravity responsive element is spherical and is located in a dished recess which is concave to the firing pin and which is formed by said casing, there being an axially extending passage which extends from the center of the recess towards the plunger to receive a portion of the plunger which is slidable therein.

* * * * *